US010573972B2

(12) United States Patent
Murakowski et al.

(10) Patent No.: US 10,573,972 B2
(45) Date of Patent: Feb. 25, 2020

(54) PHASED-ARRAY ANTENNA WITH IN-PLANE OPTICAL FEED AND METHOD OF MANUFACTURE

(71) Applicant: Phase Sensitive Innovations, Inc., Newark, DE (US)

(72) Inventors: Janusz Murakowski, Bear, DE (US); Dennis Prather, Newark, DE (US); Peng Yao, Newark, DE (US)

(73) Assignee: Phase Sensitive Innovations, Inc., Newark, DE (US)

( * ) Notice: Subject to any disclaimer, the term of this patent is extended or adjusted under 35 U.S.C. 154(b) by 0 days.

(21) Appl. No.: 16/214,742

(22) Filed: Dec. 10, 2018

(65) Prior Publication Data

US 2019/0109385 A1 Apr. 11, 2019

Related U.S. Application Data

(63) Continuation of application No. 15/481,382, filed on Apr. 6, 2017, now Pat. No. 10,158,179.

(60) Provisional application No. 62/318,866, filed on Apr. 6, 2016.

(51) Int. Cl.

| | |
|---|---|
| ***H01Q 21/00*** | (2006.01) |
| ***H01Q 15/14*** | (2006.01) |
| ***H01Q 3/26*** | (2006.01) |
| ***H01Q 21/22*** | (2006.01) |
| ***H01Q 9/28*** | (2006.01) |

(52) U.S. Cl.

CPC ..... *H01Q 21/0037* (2013.01); *H01Q 3/2676* (2013.01); *H01Q 9/28* (2013.01); *H01Q 15/14* (2013.01); *H01Q 21/22* (2013.01)

(58) Field of Classification Search

CPC .. H01Q 21/0037; H01Q 15/14; H01Q 3/2676; H01Q 9/28; H01Q 21/22

USPC ..... 343/818

See application file for complete search history.

(56) References Cited

U.S. PATENT DOCUMENTS

| | | | | |
|---|---|---|---|---|
| 6,020,850 | A * | 2/2000 | Ji | H01Q 3/2676 342/368 |
| 6,388,616 | B1 * | 5/2002 | Zhou | G02B 26/00 342/375 |
| 7,382,983 | B2 * | 6/2008 | Mizuma | H01Q 3/2676 342/368 |
| 9,614,280 | B2 * | 4/2017 | Shi | H01Q 3/2682 |
| 10,158,179 | B2 * | 12/2018 | Murakowski | H01Q 9/28 |

* cited by examiner

*Primary Examiner* — Brian K Young

(74) *Attorney, Agent, or Firm* — Muir Patent Law, PLLC

(57) ABSTRACT

A phased antenna array comprises a plurality of antennas and photodiodes arranged on a substrate. Each antenna is driven by an electrical signal output by the photodiode. The photodiodes each receive an optical signal via an optical fiber. The optical fibers conform to the sheet-like shape of the antenna array (which may be planar or curved) and optically communicate with a corresponding photodiode via a corresponding reflector, such as a ninety degree reflector. The reflectors may comprise a v-groove in a silicon substrate on which the optical fiber is positioned and a reflecting surface. Each reflector may be attached to the substrate or a ground plane positioned parallel to the substrate and the optical fiber may connect to the reflector in a direction running parallel to the phased antenna array. This optical feed network may accommodate tight spacing of the antenna elements (such as spacing less than 5 mm apart) with a thin profile.

40 Claims, 9 Drawing Sheets

FIG. 1
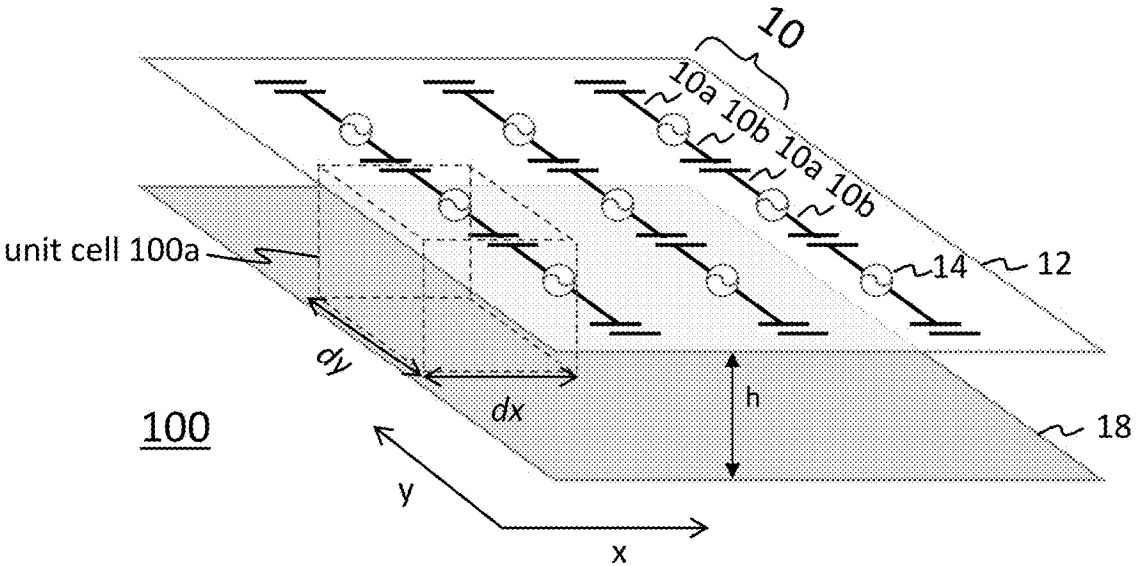
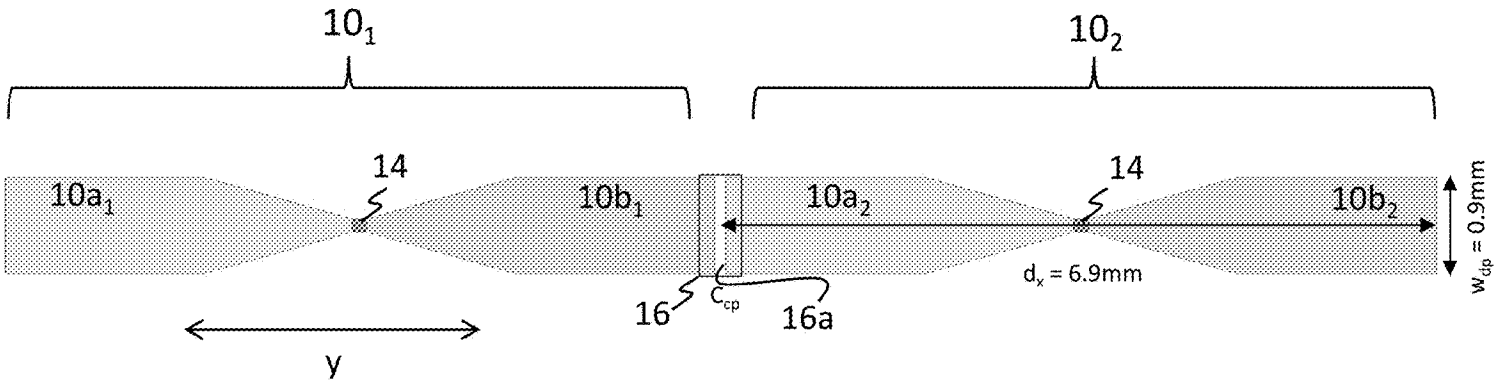
FIG. 2

PHASED-ARRAY ANTENNA WITH IN-PLANE OPTICAL FEED AND METHOD OF MANUFACTURE

RELATED APPLICATION

This application is a continuation of and claims priority to U.S. patent application Ser. No. 15/481,382, filed on Apr. 6, 2017, which claims domestic priority to U.S. Provisional Application No. 62/318,866, filed Apr. 6, 2016, the entire contents of each of which are hereby incorporated by reference.

FIELD OF TECHNOLOGY

The herein described subject matter and associated exemplary implementations are directed to an optically fed antenna array and method of manufacture of an optically fed antenna array.

BACKGROUND

Conformal, low profile, and wideband phased arrays have received increasing attention due to their potential to provide multiple functionalities over several octaves of frequency, using shared common apertures for various applications, such as radar, ultra-fast data-links, communications, RF sensing, and imaging. These arrays offer tremendous advantages, including multiple independently steerable beams, polarization flexibility, and high reliability.

With high frequency operation, high input resistance in transmitting the RF signal driving to the antenna may cause an imbalanced operation of the radiating elements of the antenna. Conventional 50-Ω coaxial line feeding the RF signal to the antenna are often unsuited for a balanced operation of the antenna. As a result, a balanced-to-unbalanced transformer, i.e., a balun, as well as an impedance transformer, is typically provided for each radiating element. The use of these transformers, however, can impose additional restrictions on the performance of the antenna array, such as the bandwidth, operational frequency, weight and profile, particularly at high operational frequencies, conformability, overall compactness and the additional relative high costs of these components.

Use of certain structure associated with conventional antenna arrays (such as baluns, amplifiers and/or RF transmission lines) may be reduced or avoided altogether by optically feeding the RF information to the antenna array, such as with optical fibers. For example, in an optically-fed phased-array architecture, transmitting signals are converted from the electrical domain to the optical domain by using electro-optic (EO) modulators, transmitted to the antenna array via optical fibers. Each optical fiber outputs its optical signal to a photodiode/antenna pair, where the photodiode receives the optical signal output from the optical fiber and outputs an electrical signal to drive the antenna to which it is connected. Such antenna arrays can have low impact in the physical space they occupy and may be implemented with a low height profile and may be formed conformally to non-planar surfaces. However, complexities in installation of the antenna array may make it difficult to easily take advantage of the small form factor and conformal configurations available for such optically fed antenna arrays.

SUMMARY

According to some embodiments, a phased antenna array comprises an antenna array substrate and a conductive ground plane spaced apart from the antenna array substrate at a substantially constant distance and having a shape conforming to the shape of the antenna array substrate, the antenna array substrate having an inner surface and an outer surface opposite the inner surface, the conductive ground plane having an inner surface and an outer surface opposite the inner surface, where the inner surface of the antenna array substrate and the inner surface of the ground plane face each other; a plurality of antennas arranged on the outer surface of the substrate; a plurality of photodiodes arranged on the inner surface of the substrate, each of the photodiodes having an electrical connection through the substrate to a corresponding antenna to drive the corresponding antenna; a plurality of reflectors, each positioned to be in optical communication with a corresponding one of the photodiodes; and a plurality of optical waveguides (e.g., optical fibers) extending in a direction conforming to at least one of the inner surfaces or outer surfaces of the antenna array substrate and the ground plane, each of the optical fibers connected to a corresponding reflector to provide a optical signal to a corresponding one of the photodiodes via the corresponding reflector.

Each of the reflectors may be attached to the outer surface of the ground plane, and configured to reflect the optical signal provided by a corresponding connected optical fiber through a corresponding hole in the ground plane to impinge the corresponding photodiode.

The optical fibers run parallel to the outer surface of the ground plane. All of the fibers may extend across one side of the phased array (e.g., across a side of a rectangular formed substrate/ground plane).

Each reflector may comprise a silicon substrate having a reflecting surface and a first v-groove extending from a side surface of the silicon substrate to a reflecting surface in which a corresponding one of the optical fibers is positioned. The reflectors are each configured to emit an incident light beam received from a corresponding waveguide at an angle substantially equal to ninety degrees.

Each reflector may include a transparent cover attached to a surface of the silicon substrate and covering the first v-groove formed in the silicon substrate.

Each reflector may also include a transparent material filling the first v-groove. The transparent material may have an index of refraction of the transparent material is substantially the same as an index of refraction of material forming the optical fibers, such as the material forming the core or the cladding of the optical fiber.

In some examples, the reflector may also include a second v-groove having an axis perpendicular to an axis of the first v-groove. A side wall of the second v-groove may form the reflecting surface of the reflector.

In some examples, axes of each of the first v-grooves all extend substantially in the same direction.

In some examples, a total thickness of the phased antenna array is less than 9.2 mm. An operating frequency of the phased antenna array may extend from 4 GHz to 15 GHz. The phased antenna array may be a tightly coupled array.

Methods of manufacturing the phased antenna array and its optical feed network are also disclosed.

BRIEF DESCRIPTION OF THE DRAWINGS

The present disclosure now will be described more fully with reference to the accompanying drawings, in which various embodiments are shown including:

FIG. 1 illustrates one example embodiment of an antenna array 100;

FIG. 2 illustrates exemplary details of two of the dipole antennas 10 of two neighboring unit cells 100*a* of FIG. 1;

DETAILED DESCRIPTION

Figure 3A:
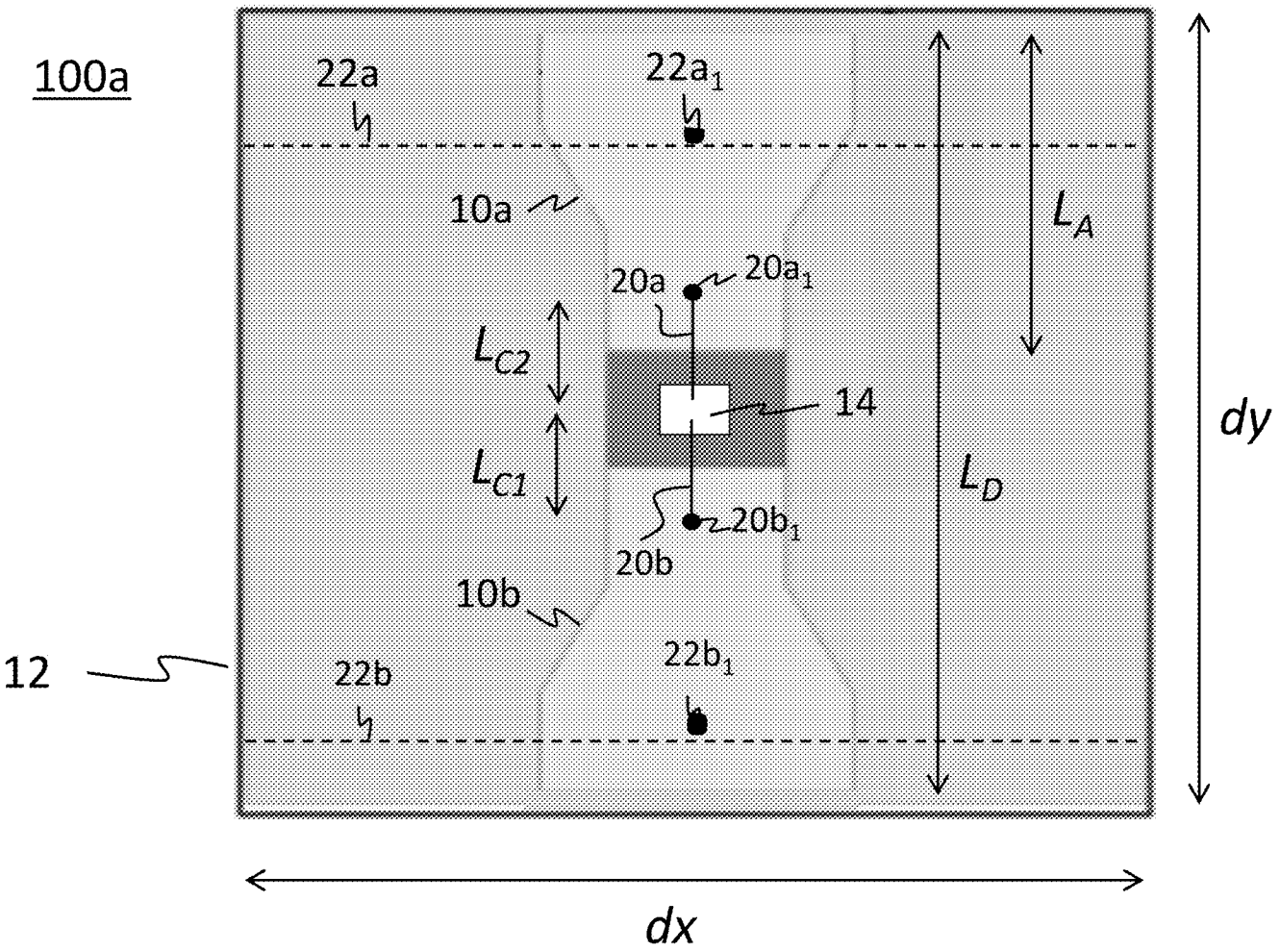
FIG. 3A is a simplified top down view of an exemplary unit cell 100*a* of the phased array 100 of FIG. 1.

The present disclosure now will be described more fully hereinafter with reference to the accompanying drawings, in which various exemplary implementations are shown. The invention may, however, be embodied in many different forms and should not be construed as limited to the exemplary implementations set forth herein. These example exemplary implementations are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

In the drawings, the size and relative sizes of layers and regions may be exaggerated for clarity. Like numbers refer to like elements throughout. Though the different figures show variations of exemplary implementations, these figures are not necessarily intended to be mutually exclusive from each other. Rather, as will be seen from the context of the detailed description below, certain features depicted and described in different figures can be combined with other features from other figures to result in various exemplary implementations, when taking the figures and their description as a whole into consideration.

The terminology used herein is for the purpose of describing particular exemplary implementations only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/".

It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, or as "contacting" or "in contact with" another element, there are no intervening elements present. Other words used to describe the relationship between elements should be interpreted in a like fashion (e.g., "between" versus "directly between," "adjacent" versus "directly adjacent," etc.).

Terms such as "about" or "approximately" or "on the order of" may reflect amounts, sizes, orientations, or layouts that vary only in a small relative manner, and/or in a way that does not significantly alter the operation, functionality, or structure of certain elements. For example, a range from "about 0.1 to about 1" may encompass a range such as a 0%-5% deviation around 0.1 and a 0% to 5% deviation around 1, especially if such deviation maintains the same effect as the listed range.

As used herein, items described as being "electrically connected" are configured such that an electrical signal can be passed from one item to the other. Therefore, an electrically conductive component (e.g., a wire, pad, internal electrical line, etc.) may be physically connected to but not electrically connected to an electrically insulative component (e.g., a polyimide layer of a printed circuit board, an electrically insulative adhesive connecting two devices, an electrically insulative underfill or mold layer, etc.). Moreover, items that are "directly electrically connected," to each other may be electrically connected through one or more connected conductors, such as, for example, wires, pads, internal electrical lines, through vias, etc. As such, directly electrically connected components do not include components electrically connected through active elements, such as transistors or diodes. Directly electrically connected elements may be directly physically connected and directly electrically connected.

FIG. 1 illustrates one example embodiment of an antenna array 100 which may embody aspects of the invention according to some examples. The antenna array 100 may have a low profile, be light weight, and/or have good conformability (e.g., where the antennas of the antenna array are not all located in a single plane, such as being mounted on a surface of a convex shaped hull or wing of an aircraft). The embodiment of FIG. 1 is implemented with dipole antennas 10 and provides details of a phased antenna array 100 (which is also referred to herein as a "phased array") implemented as a tightly coupled array ("TCA") of dipole antennas 10, it will be apparent that the invention is applicable other types of antennas and antenna arrays. For example, the invention may be implemented with other antennas and with dipole antennas having different configurations, including monopole antennas, horn antennas, fractal antennas, loop antennas, patch antennas, spiral antennas, etc. The antenna array may be implemented as a current sheet antenna (CSA) that can be realized by connected-dipole arrays wherein adjacent dipoles are connected. CSAs may take many different forms of antennas such as: connected-dipole arrays which may possess lower cross polarization in radiation, less reactive energy confined in the feed, and broader impedance matching independently from the scan angle; interleaved spiral arrays which may have a wide bandwidth (often with relatively high cross polarization); and fragment arrays which may exploit a genetic algorithm (GA) to synthesize broadband apertures.

The exemplary implementation of a photodiode-coupled phased array 100 shown in FIG. 1 is comprised of an array of dipole antennas 10 excited by photodiodes 14 arranged on a substrate 12. The substrate 12 has an outer surface on which antennas 10 are arranged and an inner surface facing ground plane 18. Photodiodes 14 may be arranged on the inner surface of the substrate 12. Each unit cell 100*a* of the phased array 100 comprises a dipole antenna 10 having two conductive radiating arms 10*a* and 10*b* and a photodiode 14 electrically connected to radiating arms 10*a* and 10*b* to act as a driving source for the dipole antenna 10 of the unit cell. In this example, the phased array 100 comprises a plurality of unit cells 100*a* regularly arranged in the x and y directions of FIG. 1. The unit cells 100*a* (and thus the structure of the unit cells 100*a*, including the dipole antennas 10 and photodiodes 14) are arranged on the substrate 10 with a pitch of dx along the x-axis and with a pitch of dy along the y-axis.

In this example, for each pair of a dipole antennas 10 and photodiode 14 of a unit cell 100*a*, an anode 14*a* of the photodiode 14 is electrically connected to one of the radiating arms 10*a* and a cathode 14*b* of the photodiode 14 is connected electrically connected to another of the radiating arms 10*b*. The radiating arms 10*a* and 10*b* of the dipole antenna extend away lengthwise in the y-direction from the photodiode 14 to which they are connected. Dipole antennas 10 are aligned on substrate 12 in rows extending in the y-direction and radiating arms 10*a*, 10*b* of neighboring dipole antennas 10 in the y-direction are electrically connected via a capacitor 16.

Substrate 12 may be a sheet formed from a single printed circuit board or a group of interconnected circuit boards. The printed circuit board(s) forming substrate 12 may comprise a stack of insulating layers (e.g., polyimide) that insulate wiring disposed between the insulating layers, the wiring providing electrical connections (discussed below) to the dipole antennas 10. The substrate 12 need not be planar as shown in FIG. 1, and instead may comprise curved surfaces, such as a concave and/or convex surface. For example, the substrate 12 may comprise or be formed to conform to a spherical surface or conform to a curved surface (e.g., body or wing) of an aircraft. It will be appreciated that the positioning of the dipole antennas 10 are dependent on their placement on substrate 12 in this example, and thus may also have a non-planar configuration and may be the same non-planar configuration as described herein with respect to the substrate 12. The radiating arms 10*a* and 10*b* of the dipole antennas 10 may also be non-planar and have a curved shape to conform to a curved surface of the substrate 12 on which they are formed.

Ground plane 18 comprises a sheet metal spaced a constant distance h away from the dipole antennas 10 on the substrate 12. The distance may be about the distance of a quarter wavelength of the intermediate frequency of the operational frequency range. In an example where the operational frequency is 4-15 GHz, h may be about 6.5 mm+/−10% for example. However, other frequency ranges may allow for a different spacing h, such as less than 5 mm or less, such as between 10 mm and 50 mm, or greater. Although ground plane 18 is shown as a rectangular planar sheet, ground plane 18 may also have other geometries, including the non-planar structure as described with respect to substrate 12 to conform to a non-planar positioning of the dipole antennas 10. While FIG. 1 has been shown to include a ground plane, other exemplary implementations operate without the provision of a ground plane.

An optical feed network (not shown in FIG. 1, see FIG. 6F) may be provided as a plurality of optical waveguides, such as optical fibers, which extend across and conform to an inner or outer surface the ground plane 18 and/or substrate 12. When the substrate 12 and ground plane 18 have a planar geometry as shown in FIG. 1, the optical fibers may extend in a direction parallel to the planar surfaces of the substrate 12 and ground plane 18.

FIG. 2 illustrates exemplary details of two of the dipole antennas 10 of two neighboring unit cells 100*a* of FIG. 1. The two dipole antennas 10 are aligned in a row of a plurality of these dipole antennas 10, this row extending in the y-direction of FIG. 1. As shown in FIG. 2, the radiating arm $\mathbf{10}b_1$ of dipole antenna $\mathbf{10}_1$ is adjacent to radiating arm 10*a*2 of dipole antenna $\mathbf{10}_2$. Dipole antennas $\mathbf{10}_1$ and $\mathbf{10}_2$ may have the same shape and size. In this example, the radiating arms 10*a* and 10*b* of the dipole antennas 10 are formed as metal plate or a planar sheet of metal, such as gold, silver or aluminum.

The radiating arms 10*a* and 10*b* may be formed by patterning a metal layer that has been deposited on substrate 12 using conventional printed circuit board manufacturing technology. For example, radiating arms 10*a* and 10*b* may be formed by selectively etching a deposited metal layer using an etching mask. Alternatively, radiating arms 10*a* and 10*b* may be formed by printing a conductor onto substrate 12, such as, e.g., using a 3D printer, ink-jetting a conductive ink, etc.

Alternatively, the radiating arms 10*a* and 10*b* may be formed as part of a semiconductor chip and the semiconductor chip may be mounted to substrate 12. In this example, the photodiode 14 connected to the dipole antenna 10 may both be integrally formed as part of the same semiconductor chip. In this case, a metal layer (e.g., an uppermost metal layer or a metal layer deposited on the backside of the semiconductor wafer) of the semiconductor chip may be patterned using conventional semiconductor technology to form the radiating arms 10*a* and 10*b* of a dipole antenna 10. For example, an insulator may be patterned by etching using a photoresist or hard mask as an etchant mask, depositing metal within openings of and on upper surfaces of the patterned insulator and performing a chemical mechanical polishing (CMP) to remove the metal deposited on and to expose the upper surface of the patterned insulator and leave metal within the openings of the patterned insulator. In this example, the metal layer forming the radiating arms 10*a* and 10*b* may be the uppermost metal layer of the semiconductor chip (e.g., at the same level as an anode and/or cathode of a photodiode and/or chip pad of the semiconductor chip). However, the radiating arms 10*a* and 10*b* may be formed on a backside of a semiconductor substrate of the chip by patterning the backside of the semiconductor wafer (from which the semiconductor chip is later singulated) rather than the insulating layer as described above. The radiating arms 10*a* and 10*b* formed on the backside of the semiconductor chip may be connected to the anode 14*a* and cathode 14*b* of the integrated photodiode (formed on the front surface of the semiconductor wafer/chip) by through substrate vias (or through silicon vias).

Capacitor 16 electrically connects the dipole antennas $\mathbf{10}_1$ and dipole antenna $\mathbf{10}_2$. The capacitor 16 may be a discrete component with one electrode of the capacitor electrically connected to radiating arm $\mathbf{10}b_1$ and the other electrode of the capacitor electrically connected to radiating arm $\mathbf{10}a_2$. Instead of or in addition to a discrete component, the structure of the capacitor 16 may comprise the outer conductive surfaces of radiating arm $\mathbf{10}b_1$ and radiating arm $\mathbf{10}a_2$ (as the electrodes of the capacitor 16) and the insulative material (e.g., air and/or the material of the substrate 12, such as polyimide) in the gap 16*a* between radiating arm $\mathbf{10}b_1$ and radiating arm 10*a*2 (as the dielectric of the capacitor 16). To achieve a desired capacitance without use of an additional discrete capacitor, the spacing (e.g., the width of gap 16*a*) between the radiating arms $\mathbf{10}b_1$ and $\mathbf{10}a_2$ of neighboring dipole antenna $\mathbf{10}_1$ and dipole antenna $\mathbf{10}_2$ should be small, such as 50 um or less, 20 um or less or 5 um or less. The capacitance of capacitor 16 may then be 0.01 pF or more, or 0.02 pF or more. The shapes, dimensions and spacing shown in FIG. 2 are exemplary. In particular, the dimensions and capacitance values will be dependent on the desired frequency range of the dipole antenna 10 and/or antenna array 100 and can thus significantly vary from this embodiment.

Figure 3B:
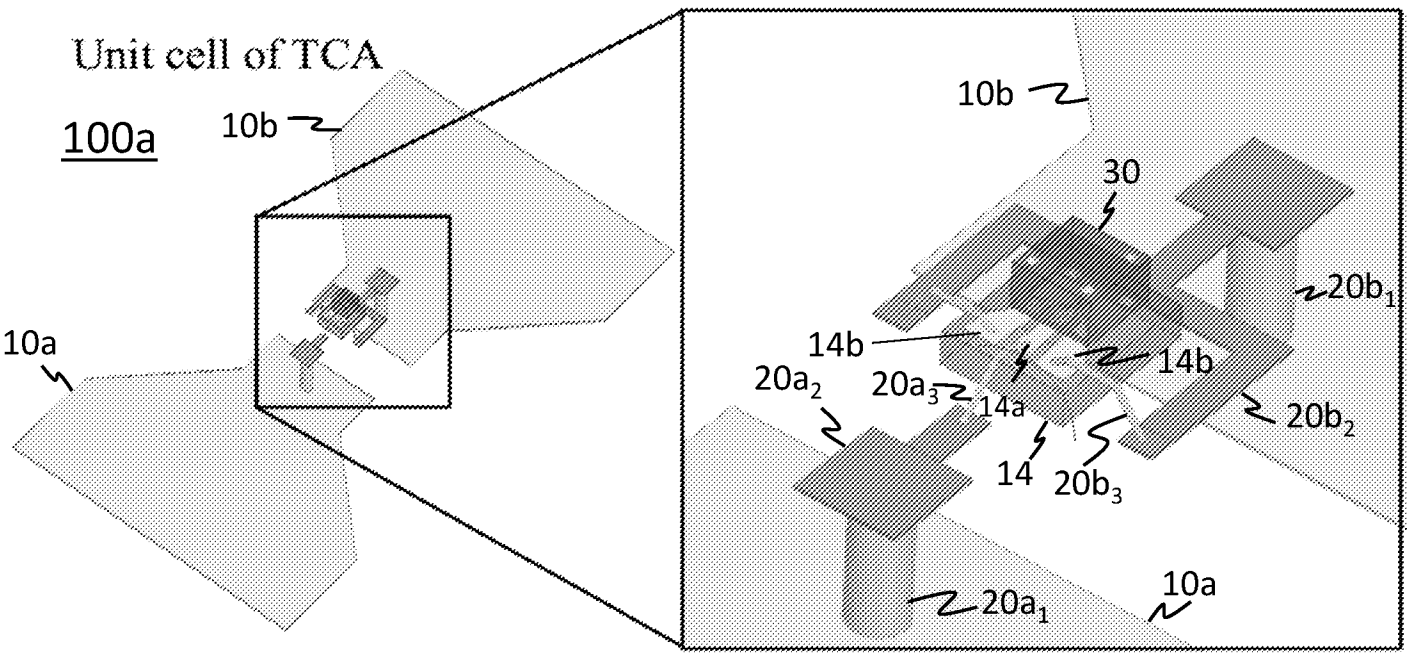
FIG. 3B is a perspective view of portions of the unit cell 100*a*.

FIG. 3A is a simplified top down view of an exemplary unit cell 100*a* of the phased array 100 of FIG. 1. FIG. 3B is a perspective view of portions of the unit cell 100*a* with ground plane 18 and substrate 12 removed except for certain wiring of the substrate 12. All details described herein in connection with FIG. 2 also relate to the following description—only the shape of the radiating arms 10*a* and 10*b* of FIGS. 3A and 3B differ from those shown in FIG. 2 but otherwise the details described and illustrated regarding FIG. 2 will be understood to be applicable to phased array 100 (and vice versa) including the following description.

As shown in FIGS. 3A and 3B, the unit cell 100*a* comprises a photodiode 14 electrically connected to radiating arms 10*a* and 10*b* of antenna 10 by conductors 20*a* and 20*b* respectively. Conductors 20*a* and 20*b* respectively connect to the bottom surface of the radiating arms 10*a* and 10*b* with a respective one of conductive vias $\mathbf{20}a_1$ and $\mathbf{20}b_1$ at a location spaced apart from the side edge of the respective radiating arm 10*a* and 10*b*. The conductors 20*a* and 20*b* may comprise, for example, wire bond wires or conductive posts that extend away from an upper surface of the respective one of radiating arm 10*a* and 10*b*. In some examples, a resistor 30 may be provided, electrically connecting radiating arms 10*a* and 10*b* via opposite terminal connections to the cathode 14*b* and anode 14*a* of the photodiode 14.

As noted, the x-y dimensions (top down view dimensions) of the unit cell 100*a* are dx in the x direction and dy in the y direction. Both dx and dy should be chosen to be less than lambda/2 where lambda is the wavelength of the electromagnetic radiation emitted by phased array 100 at the highest frequency that phased array 100 is intended for use. The length of the dipole antenna 10 may be less than dy (e.g., by 5 um or less, 20 um or less or 50 um or less), or slightly less than lambda/2 in the substrate material to allow for a gap between neighboring dipole antennas 10 as discussed previously. The antenna is fabricated on a substrate with a high dielectric constant, e.g., greater than 3.5, such as 3.66. For example, if the phased antenna array 100 is designed to operate for 4-15 GHz, the wavelength of the emitted electromagnetic radiation is 100 mm-25 mm. In this case, lambda=25 mm (corresponding to the highest frequency of 12 GHz). The use of high dielectric constant substrate will also reduce the wavelength in the antenna substrate by a factor of the effective reflective index between substrate and air sqrt(3.66+1), so in this example, wavelength= may equal 25/sqrt(1+3.66)=16.4 mm. The dipole antenna length (from tip to tip in the y direction) should be less than lambda/2 in the medium or 8.2 mm (16.4 mm/2) or less. The dx and dy dimensions of the unit cell 100*a* should also be equal to or less than lambda/2, or 8.2 mm or less in this example.

The lengths Lc1 and Lc2 of each of the conductors 20*a* and 20*b* are also preferably less than lambda/2 (e.g., less than the dipole antenna length) and more preferably less than lambda/4 (e.g., less than half of the dipole antenna length, or less than the length of a radiating arm 10*a* or 10*b* of the dipole antenna 10). In this example, conductors 20*a* and 20*b* are each 0.3 mm or less. By keeping conductors 20*a* and 20*b* short in total length (e.g., less than half of the dipole antenna 10 length, or less than the length of a radiating arm 10*a* or 10*b* of the dipole antenna 10), conductors 20*a* and 20*b* may provide the driving current to the radiating arms 10*a* and 10*b* of the dipole antenna 10 without causing problems that might otherwise result from electromagnetic radiation being emitted from conductors 20*a* and 20*b*. Thus, the anode 14*a* and the cathode 14*b* of the photodiode may be respectively connected to the radiating elements 10*a* and 10*b* without requiring a transmission line and the resulting signal imbalance resulting from use of a transmission line. Thus, baluns may not be necessary, providing a significant reduction in cost, size and complexity.

Anode bias line 22*a* (e.g., conductive wire) extends in the x direction of FIG. 1 within and/or on a bottom surface of the substrate 12. Anode bias line 22*a* is electrically connected to radiating arm 10*a* of unit cell 100*a* by a conductive via $\mathbf{22}a_1$ at least partially extending through the substrate 12 to connect to a bottom surface of the radiating arm 10*a*. Cathode bias line 22*b* (e.g., conductive wire) is spaced apart from the anode bias line 22*a*, and extends in the x direction of FIG. 1 within and/or on a bottom surface of the substrate 12. Cathode bias line 22*b* is electrically connected to radiating arm 10*b* of unit cell 100*a* by a conductive via 22*b*1 at least partially extending through the substrate 12 to connect to a bottom surface of the radiating arm 10*b*.

Each of the anode bias line 22*a* and the cathode bias line 22*b* may be made sufficiently thin so that the bias lines 22*a* and 22*b* have a much higher impedance than the radiating arms 10*a* and 10*b* of the dipole antenna 10. Thus, radiation from these bias lines 22*a* and 22*b* may only start to be problematic at a frequency much higher than the operating frequency of the dipole antennas 10. For instance, if the antenna is designed at 5-20 GHz, the radiation from two bias lines 22*a* and 22*b* may only start to occur at frequencies of 25 GHz or greater. So the presence of the bias lines 22*a* and 22*b* may not have significant impact on the dipole antenna radiation over the interested frequency band. However, in designs where the operating frequencies of the dipole antenna 10 may be in a range where the anode bias line 22*a* and cathode bias line 22*b* start to radiate (e.g., at 25 GHz or greater in the above example), the bias lines 22*a* and 22*b* may be shielded, such as by positioning them on the opposite side of the ground plane 18 (with appropriate through hole connections through the ground plane 18 to the radiating arms 10*a*, 10*b*). In addition or in the alternative, a first inductor may be connected between the anode bias line 22*a* and the anode 14*a* of the photodiode 14, and a second inductor may be connected between the cathode bias line 22*b* and the cathode 14*b* of the photodiode 14. The first and second inductors may act as RF chokes to remove/filter the RF signal from the DC signal so that only the DC signals (e.g., ground or Vbias) are provided to the photodiode 14.

Anode bias line 22*a* extends across the array of dipole antennas 10 of the phased array 100 to connect the radiating arms 10*a* of antennas 10 that are aligned in a row in the x direction. Cathode bias line 22*b* extends across the array of dipole antennas 10 of the phased array 100 to connect the radiating arms 10*b* of antennas 10 that are aligned in a row in the x direction. The anode bias line 22*a* is connected to ground or other reference DC voltage. The cathode bias line 22*b* is connected to voltage source to provide a DC bias voltage Vbias. Together, the anode bias line 22*a* and cathode bias line 22*b* apply a reverse bias voltage across the photodiode 14 of the unit cell 100*a* to which they are connected (along with all other photodiodes of the unit cells 100*a* of the phased array 100 to which they are connected). Specifically, a ground voltage (potential) is applied to the anode 14*a* of photodiode 14 due to the electrical connection of the photodiode anode 14*a* to the anode bias line 22*a* through conductor 20*a* and radiating element 10*a*. The DC bias voltage Vbias is applied to the cathode 14*b* of photodiode 14 due to the electrical connection of the photodiode cathode 14*b* to cathode bias line 22*b* through conductor 20*b* and radiating element 10*b*.

Further details of the phased array 100, including details of the photodiodes 14, antennas 10, their arrangement and operation, as well as alternatives to the same that may also be implemented as part of the present invention are disclosed in U.S. patent application Ser. No. 15/242,459, the details of which are hereby incorporated by reference in their entirety.

Figure 3C:
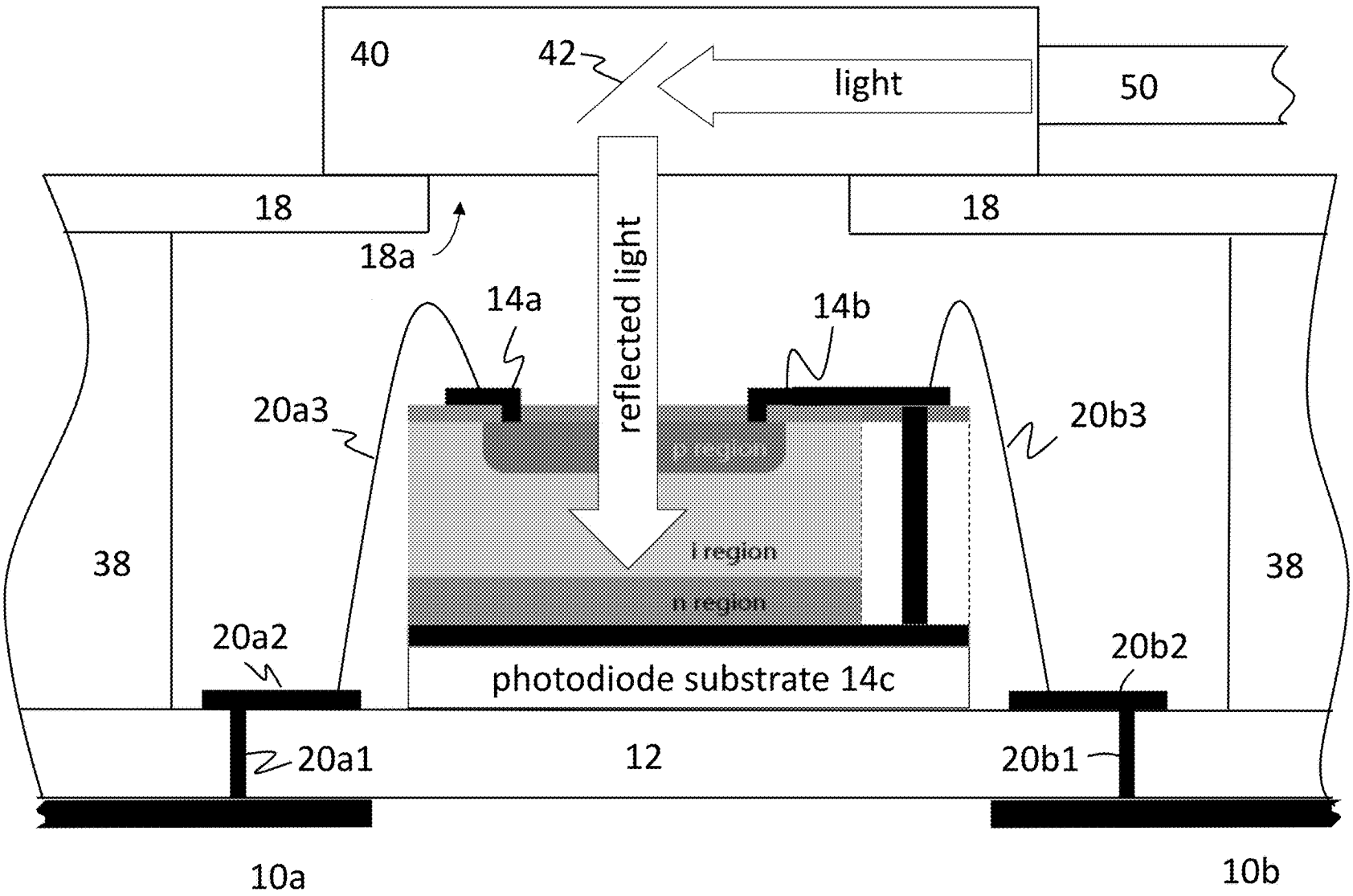
FIG. 3C is a simplified cross sectional view of unit cell 100*a*.

FIG. 3C is a simplified cross sectional view of the photodiode 14 and a simplified representation of an optical signal transmission path to photodiode 14, electrical connections between the photodiode 14 and the antenna 10, and exemplary structure of the unit cell 100*a* adjacent the photodiode 14. Substrate 12 is separated from ground plane 18 via spacers 38 (which may take any form to provide a desired spacing between the antenna 10 and ground plane according to desired frequency of operation, as discussed elsewhere herein). Photodiode 14 is mounted on substrate 12. Photodiode 14 may comprise a PIN diode 14*d* formed of a p-doped region, an intrinsic region and an n-doped region of one or more semiconductor materials. The PIN diode 14*d* may be formed on a substrate 14*c* of the photodiode 14 which is mounted to the lower surface of substrate 12 (shown to be the upper surface in FIG. 3C). A wire 20*a*3 may connect anode 14*a* to a wiring layer 20*a*2 of substrate 12, which in turn is connected by conductive via 20*a*1 to radiating arm 10*a*. Wire 20*a*3, wiring layer 20*a*2 and conductive via 20*a*1 may comprise conductor 20*a* and have a length less than the length of the dipole antenna 10 or less than a length of the radiating arm 10*a* or 10*b* as described herein. A wire 20*b*3 may connect cathode 14*b* to a wiring layer 20*b*2 of substrate 12 which in turn is connected by conductive via 20*b*1 to radiating arm 10*b*. Wire 20*b*3, wiring layer 20*b*2 and conductive via 20*b*1 may comprise conductor 20*ab* and have a length less than the length of the dipole antenna 10 or less than a length of the radiating arm 10*a* or 10*b* as described herein.

As shown in FIG. 3C, the photodiode 14 is positioned between the radiating elements 10*a* and 10*b* allow for short lengths of conductors 20*a* and 20*b*. Further, a vertical distance between the electrodes (anode 14*a*, upper portion of cathode 14*b*) of the photodiode 14 and the radiating arms 10*a* and 10*b* is made small to minimize a parasitic capacitance resulting therefrom. In this example, the vertical distance is substantially equal to the height of the photodiode package and the width of substrate 12. Thus, the vertical distance between the electrodes 14*a*/14*b* and radiating arms 10/10*b* may be made smaller than about 7 mm with conventional PCB substrates (e.g. about 1.5 mm or less, or 0.8 mm or less, or 0.4 mm or less in thickness) and conventional LED packages (e.g., less than 5 mm in height). However, if a flip-chip mounting of the LED package is utilized, the vertical distance between the photodiode electrodes and the radiating elements 10*a* and 10*b* substantially correspond to the thickness of the substrate 12 and thus may be even smaller than 7 mm, such as about 1.5 mm or less, or 0.8 mm or less, or 0.4 mm or less, depending on the PCB substrate of the system. As will be appreciated, the vertical distance between the electrodes 14*a*/14*b* and radiating arms 10/10*b* may be made smaller than lamba/2 and smaller than the dipole antenna length.

An optical fiber 50 extends parallel to the surface of ground plane 18 to reflector 40. At or within reflector 40, the optical fiber 50 terminates. An optical signal transmitted by optical fiber 50 is emitted from the optical fiber and reflected by reflecting surface 42. The reflecting surface 42 may be positioned at a 45 degree angle with respect to the surface of the ground plane 18, creating a 90 degree bend in the optical transmission path. The reflecting surface 42 of reflector 40 thus redirects the optical signal emitted from the optical fiber towards the photodiode 14 through opening 18*a* in the ground plane 18.

The photodiode 14 receives the optical signal, converts the optical signal to an RF electrical signal that then drives antenna 10. See, e.g., U.S. Ser. No. 15/410,761, incorporated by reference in its entirety, for exemplary systems and methods to generate, modulate and transmit optical signals, to drive a photodiode coupled antenna, as well as coordinating such optical signal generation for a plurality of antennas to drive an antenna array in various manners. As shown in FIG. 3C, a direct electrical connection may be formed between the antenna radiating arm 10*a* and the anode 14*a* of photodiode 14 and a direct electrical connection is formed between antenna radiating arm 10*b* and the cathode 14*b* of the photodiode 14. No amplifier or logic gates need be used to drive the radiating arms 10*a* and 10*b* by the photodiode 14. Further, a single-ended electrical connection (rather than a differential electrical connection) may be used to connect the electrodes 14*a*, 14*b* of the photodiode 14 to a respective one of the radiating arms 10*a*, 10*b*. Thus, an imbalance in the driving of the radiating arms 10*a* and 10*b* may be avoided and the use of baluns or other complex, bulky circuitry may be avoided.

Figure 4A:
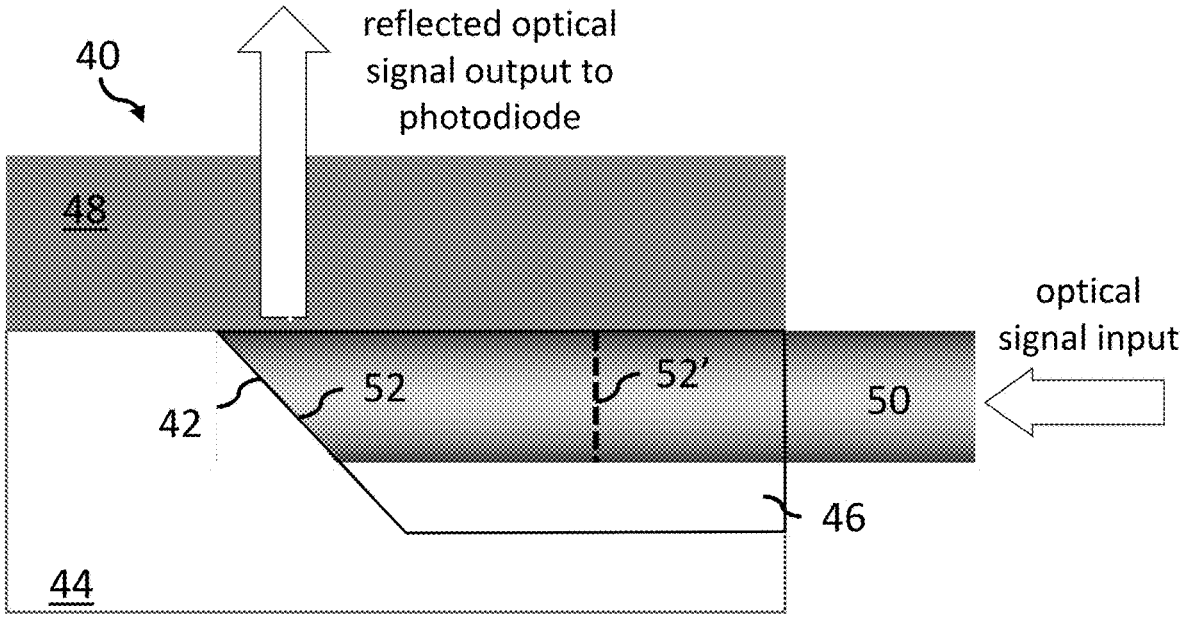
FIGS. 4A to 4E illustrate exemplary details regarding reflector 40.
Figure 4B:
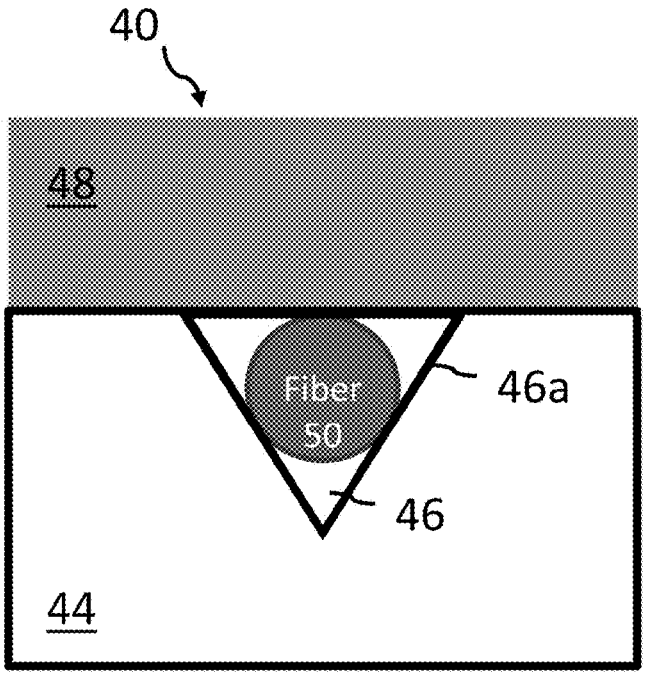
Figure 4C:
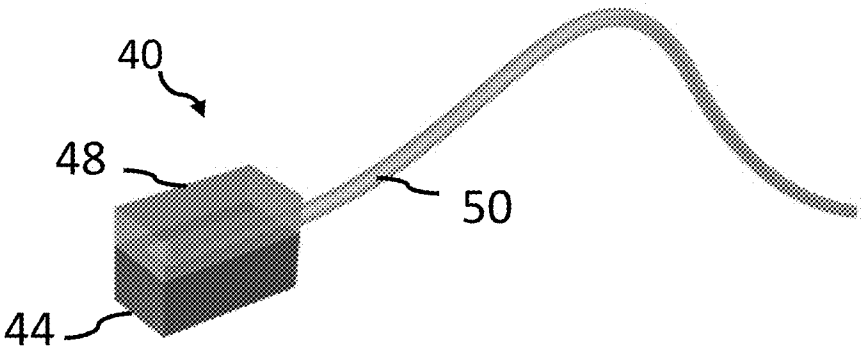
Figure 4D:
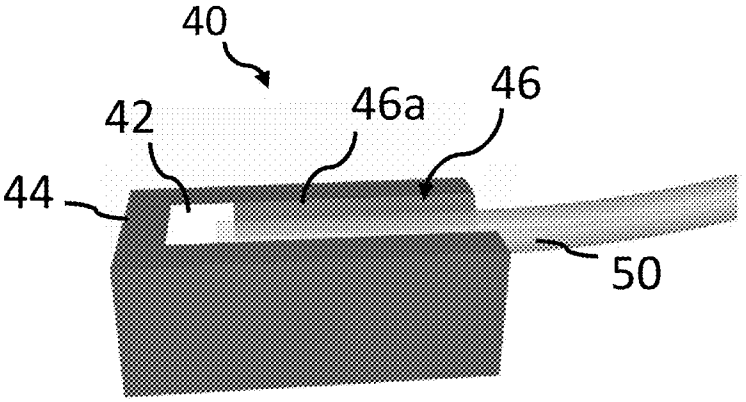

FIGS. 4A to 4D illustrate an exemplary reflector 40 according to the present invention. FIG. 4A is a cross sectional side view and FIG. 4B is a cross sectional front view of an exemplary reflector 40 coupled with an optical fiber 50. FIGS. 4C and 4D illustrate perspective view of the exemplary reflector 40, with the cover 48 removed from the illustration of FIG. 4D to provide additional detail. Reflector 40 comprises a substrate 44 and a transparent cover 48 attached to to the substrate 44. The substrate may be a crystalline substrate, such as a silicon crystalline substrate or other semiconductor substrate formed from a semiconductor wafer. The following discussion may refer to the substrate 44 as a silicon substrate, but such discussion may be equally applicable to other substrates.

A v-groove 46 is formed in silicon substrate 44. The v-groove 46 may be etched in silicon using an anisotropic etch, such as KOH, to produce angled facets including the v-groove sidewalls and an end facet forming the reflecting surface 42. The reflecting surface 42 is positioned at one end of the v-groove 46 within the silicon substrate 44. The v-groove 46 terminates at a side surface of the silicon substrate 44 (forming the second end of the v-groove 46), allowing insertion of optical fiber 50. The reflecting surface 42 may be metalized for improved reflectivity, or reflection of the optical signal provided by the optical fiber 50 may occur by total internal reflection (TIR). A transparent cover 48, such as a glass cover, is attached to the silicon substrate 44, such as with an adhesive. In some examples, the transparent cover 48 may have a concave or convex surface (e.g., the upper and/or lower surfaces of the cover 48), to focus or otherwise direct the light reflected by the reflecting surface 42.

Optical fiber 50 is placed within v-groove 46 and is supported by the oblique sidewalls 46*a* of the v-groove 46 running the length of the v-groove 46. Optical fiber 50 may terminate at surface 52 with an oblique angle substantially matching the angle of the reflecting surface 42, here 45 degrees, and surface 52 may be in contact with the reflecting surface 42. Alternatively, optical fiber 50 may terminate with a surface perpendicular to its outer cylindrical surface, such alternative terminating surface of optical fiber 50 represented by dashed line at surface 52' in FIG. 4A. The portion of the v-groove 46 that is not occupied by optical fiber 50 may be occupied by air or other gas. Alternatively, the portion of the v-groove 46 may be filled with a material having an index of refraction that substantially the same as the index of refraction of the material the optical fiber 50 (the same as or within the range of the index of refraction of the core of the optical fiber and the cladding of the optical fiber 50) and/or matches the index of refraction of the cover 48. For example, when the optical fiber 50 terminates at an oblique angle surface 52 to conform with reflecting surface 42, the v-groove 46 may be filled with the same material as the cladding of the optical fiber 50 (or having an index of refraction substantially the same as the cladding of the optical fiber 50), such as 1.444. When the optical fiber 50 terminates at a perpendicular surface 52', the v-groove 46 may be filled with the same material as the core of the optical fiber 50 (or a material having an index of refraction substantially the same as the core of the optical fiber, such as about 1.4475). For example, when the v-groove 46 terminates with oblique surface 52 or perpendicular surface 52' and the cover 48 is a glass cover, the v-groove 46 may be filled with the same glass material as the glass cover 48.

Figure 4E:
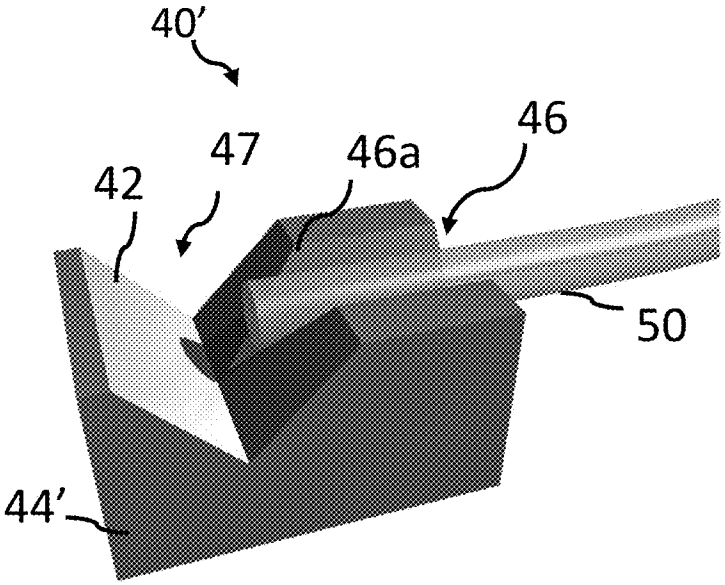

FIG. 4E illustrates an alternative substrate 44' that may be used in place of the substrate 44 described above. The substrate 44' may be the same as substrate 44 except that an additional v-groove 47 may be formed to extend in a perpendicular direction to the extending direction of v-groove 46; second v-groove 47 may extend in a direction perpendicular to the axis of the optical fiber having one oblique surface forming reflecting surface 42 and a second oblique surface opposite to the reflecting surface 42 where first v-groove 46 terminates. One or both of first v-groove 46 and second v-groove 47 may be obtained by sawing the silicon substrate 44'. The saw may also act to polish the surfaces forming the second v-groove 47 while cutting the second v-groove 47. When cutting second v-groove 47, dicing saw should have a blade geometry and blade position to produce a reflective facet at about 45 degrees with respect to the axis of optical fiber 50 (or with respect to the axis of groove 46 that will align with the axis of the optical fiber 50). Although optical fiber 50 is shown to terminate with a perpendicular surface (corresponding to surface 52' in FIG. 4A), it will be appreciated that the substrate 44' may be implemented with all the various features and alternatives described above, including use of an oblique terminating surface 52 of optical fiber 50 and various index matching material options for filling remainder of grooves 46 and 47 not occupied by optical fiber 50.

Figure 5A:
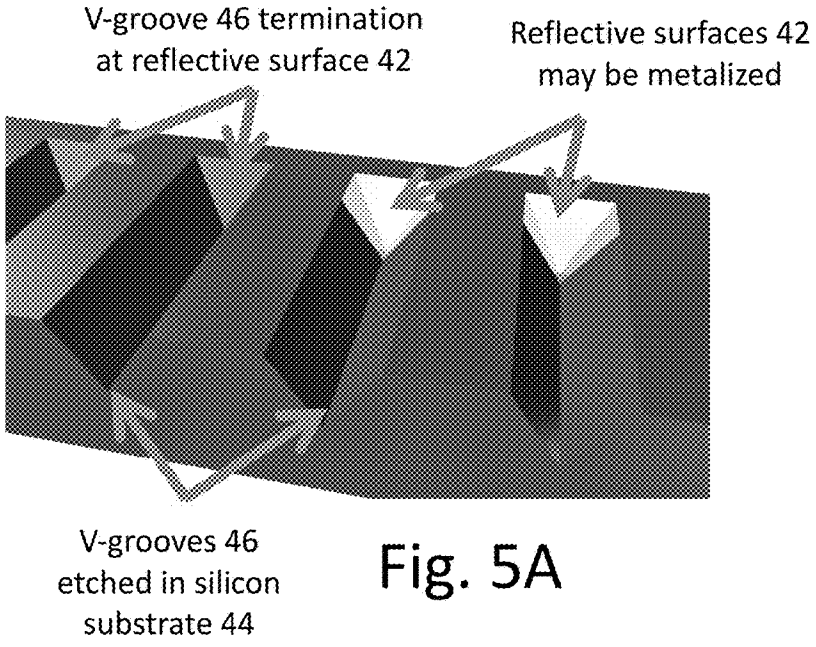
FIGS. 5A to 5D illustrate an exemplary method of manufacturing and further details of the reflectors.

FIGS. 5A to 5D illustrate an exemplary method of manufacturing and further details of the reflectors 40 prior to assembly with the phased array 100. FIG. 5A illustrates a crystalline substrate 44 having a plurality of v-grooves 46 formed therein. The v-grooves 46 may be formed by anisotropically etching a crystalline substrate 44. For example, a crystalline silicon wafer with a silicon (100) upper surface may be selectively etched with KOH by forming mask on the (100) surface of the silicon wafer with openings corresponding to the openings of v-grooves 46. As etching of the crystalline planes of the silicon substrate are etched at different rates via KOH, sidewalls 46*a* of the v-grooves 46 are formed by (111) surfaces of the silicon substrate 44. The end of each v-groove 46 is similarly formed to provide reflecting surface 42.

In some examples, the reflecting surface 42 may not be formed at a 45 degree angle with respect to the axis of the v-groove 46 to which it faces. For example, the surface angle may be formed at 54.7 degrees due to the crystal facets of crystalline silicon. Thus, the resulting optical signal reflected by reflecting surface 42 may not form a ninety degree angle with respect to the input optical signal incident on the reflecting surface 42. In this instance, the optical signal output by the reflector 42 may be made perpendicular to the surface of the ground plane 18 as desired. As discussed with respect to FIG. 4E, a second v-groove 47 may be formed at this time (not shown in FIGS. 5A-5E) by sawing the silicon substrate 44 in a direction perpendicular to the axis of the first v-grooves 46 where the saw blade and/or saw blade angle with respect to the silicon substrate 44, to replace the facet initially forming the end of each v-groove 46 with reflecting surface 42 having the desired 45 degree angle. Alternatively, the glass cover 48 attached to the silicon substrate 44 may form a prism, so that the top and bottom surfaces of the glass cover are not parallel to each other but form an angle. In this alternative, the reflecting surface 42 may remain at an angle that is not 45 degrees (e.g., between 60 and 30 degrees). The optical signal then exits the reflector at an angle with respect to the upper surface of the glass cover 48 (formed as a prism) which then acts to bend the optical signal to a 90 degree angle with respect to the axis of the v-groove 46 of the reflector 40. In another alternative, the optical signal output by the reflector 40 may be left unmodified and output with an angle other than 90 degrees, while the mounting surface of the reflector 40 (which may be the top or bottom surface as shown in the figures) may be made stepped or angled to rotate the structure of the reflector 40 to obtain an output optical signal that is 90 degrees with respect to the surface to which it is mounted (e.g., 90 degrees with respect to the ground plane 18).

Reflecting surface 42 may optionally be coated with a film reflective metal, such as Al, Au or Ag. The metalization may result in a film of constant thickness that is conformally formed on the reflecting surfaces 42. For purposes of description, only two reflecting surfaces 42 are shown in FIG. 5A as being coated with a reflective metal, however, all or none of the reflective surfaces 42 cut into the silicon wafer may be metalized. To minimize processing steps, the entire v-groove 46 may be coated with a reflecting metal (not shown), or only the reflecting surface 42 may be coated by removing the v-groove formation mask, and forming a second mask patterned to expose the reflecting surfaces 42 (e.g., via a strip opening in the second mask extending over all of the reflecting surfaces 42 of the v-grooves 46). The deposition of the reflecting metal may be performed by conventional semiconductor manufacturing techniques, such as CVD or electroplating. The silicon substrate may then be subjected to an initial cutting process separate groups of v-grooves 46, with each group of v-grooves 46 arranged in a row (as shown in FIGS. 5A-5C) or arranged in two rows (not shown—where the structure of silicon substrate 44 of FIG. 5B is duplicated and integral with two rows of v-groove openings on opposite side surfaces of the silicon substrate 44, rather than a single row of v-groove openings on a single side surface of silicon substrate 44 as shown in FIG. 5B).

Figure 5B:
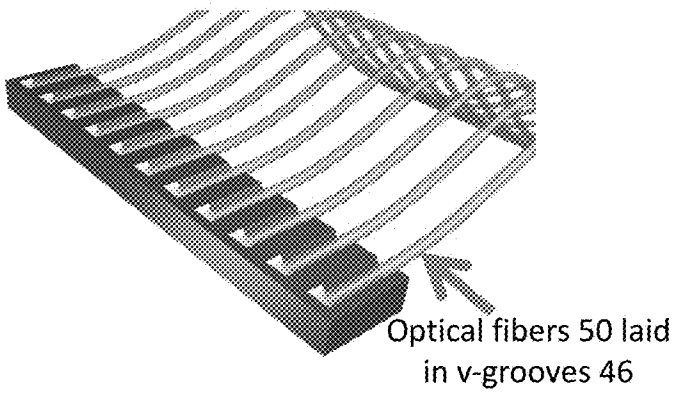
Figure 5C:
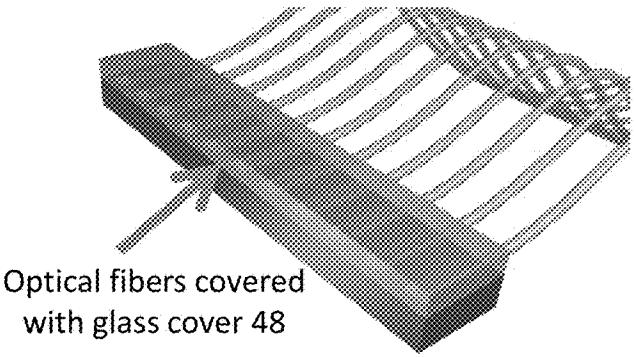

An optical fiber is then placed in each of the v-grooves 46 (FIG. 5B). The optical fibers 50 each may have the structure described herein, such as an oblique surface 52 or a perpendicular surface 52' forming the end of the optical fiber 50 (see FIG. 4A and related description). Transparent glass cover 48 may then be attached to the top surface of the silicon substrate 44 with an adhesive.

Optionally, before or after attaching transparent glass cover 48, gaps in the v-grooves 46 not occupied by the optical fibers 50 may be filled, such as with a dielectric constant matching material (e.g., similar to the optical fiber 50 (inner core or outer cladding) and/or glass cover 48). For example, prior to attaching the transparent glass cover 48, the v-groove filling material may be deposited over the entire surface of the substrate 44 and within the v-grooves 46 and then planarizing the resultant structure so that upper surfaces of the v-groove filling material are co-planar with the upper surface of the silicon substrate 44. It is possible that even though the v-groove is filled with the v-groove filling material, some of the v-groove filling material may be blocked by the optical fiber 50 from filling the lowermost portions of the v-groove 46 and a gap may remain at such locations. Transparent glass cover 48 may then be attached to the top surface of the silicon substrate 44 with an adhesive. Alternatively, the glass cover 48 may not be necessary.

As another example, the glass cover may first be attached to the silicon substrate 44 prior to adding the v-groove filling material. A molding injection process may be used to then add the v-groove filling material into the remaining voids within the v-grooves 46.

Figure 5D:
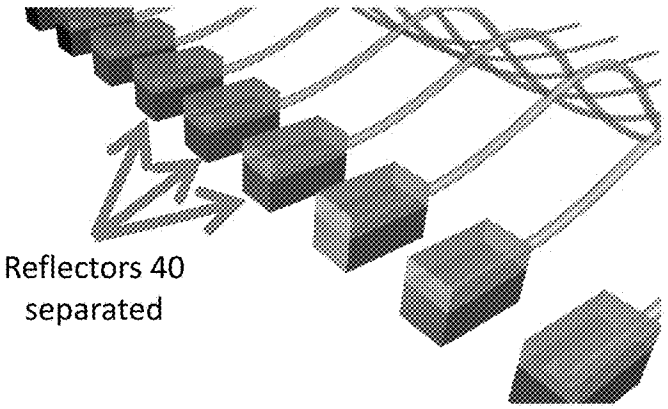

Then, as shown in FIG. 5D, the integrally formed group of reflectors shown in FIG. 5C is is subject to a second cutting process to separate the reflectors 40 into individual, separate reflectors. Conventional semiconductor singulation techniques may be implemented to separate the reflectors 40 from each other, such as cutting by laser or by a saw.

Figure 6A:
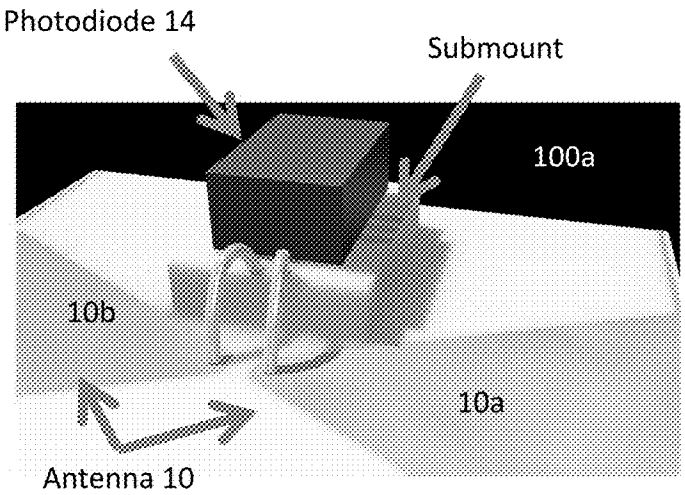
FIGS. 6A to 6F illustrate additional steps to manufacture and further details of the antenna array 100.
Figure 6B:
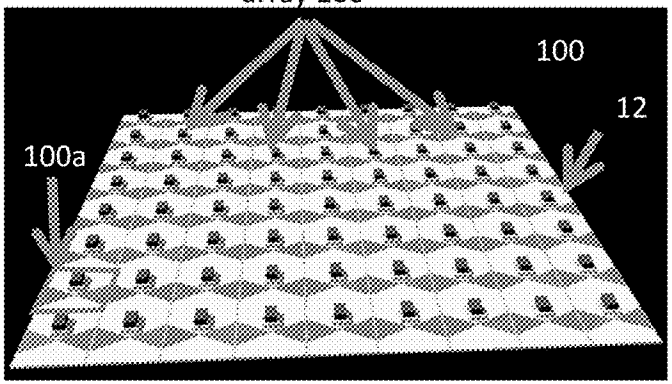

FIGS. 6A to 6F illustrate additional steps to manufacture and further details of the antenna array 100. FIG. 6B is a perspective illustration of an antenna array 100 comprising a rows and columns unit cells 100*a* each including an antenna 10/photodiode 14 pair. FIG. 6A is a blown up perspective illustration of a single antenna 10/photodiode 14 pair of a unit cell 100*a*. The unit cell 100*a* may be implemented for each of the antenna 10/photodiode pairs of the antenna array of FIGS. 6B to 6F and have structure, connections and operations of the unit cell 100*a* as described elsewhere herein. Similarly, antenna array 100 may have structure, connections and operations of the antenna array 100 and its alternatives described elsewhere herein.

Figure 6C:
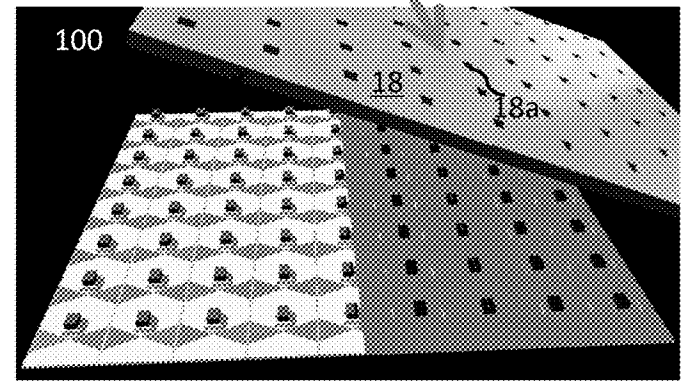
Figure 6D:
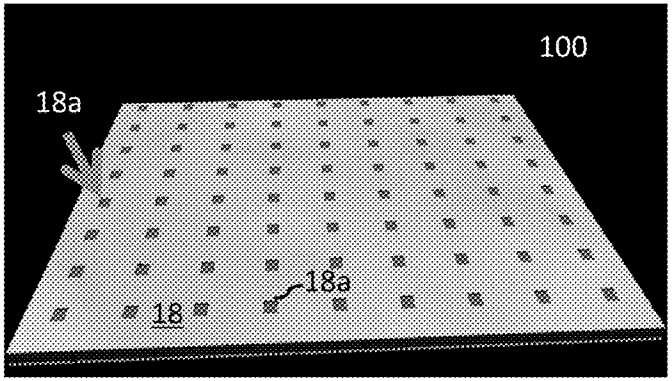

FIG. 6C illustrates a ground plane 18 including a plurality of openings 18*a* in the process of being connected to substrate 12 and FIG. 6D illustrates the antenna array 100 after ground plane 18 is connected to the substrate 12. Spacers 38 (not shown—see, e.g., FIG. 3C) may be positioned between the substrate 12 and ground plane to maintain a desired distance between the antennas 10 and the ground plane according to the desired operating frequency as described herein.

Figure 6E:
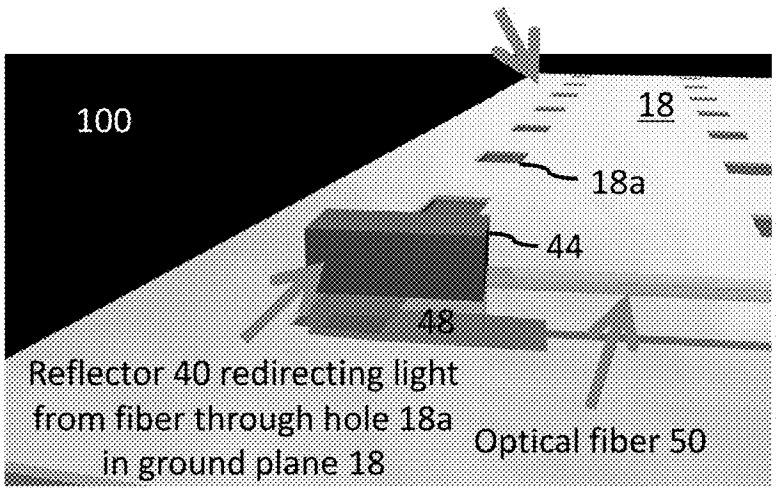
Figure 6F:
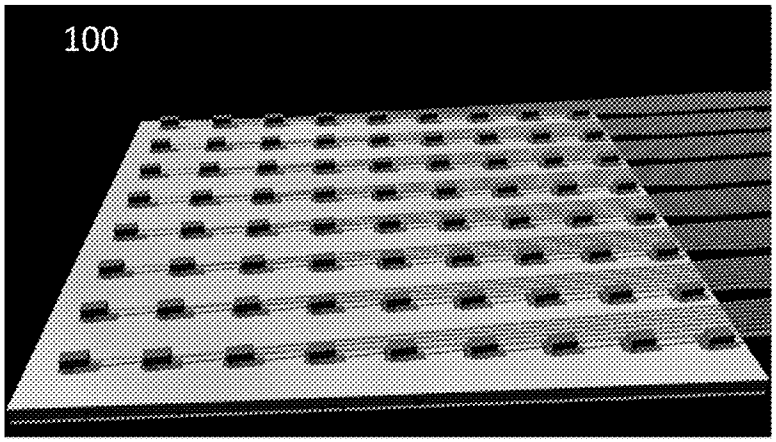

FIG. 6E illustrates a reflector 40 mounted to the ground plane 18 and having an optical fiber 50 connected to the reflector 40 as described herein. The reflector 40 may be attached to the ground plane 18 with an adhesive between the transparent cover 48 and the ground plane. The reflector 40 is positioned so that an optical signal (light) received by the optical fiber is reflected through a hole 18*a* and onto a corresponding photodiode 14 of a unit cell 100*a* to thereby drive the antenna 10 of the unit cell 100*a* to which the photodiode 14 is connected, as described herein. FIG. 6F illustrates a plurality of reflectors mounted on an outer surface of the ground plane (opposite the inner surface of ground plane 18 facing the substrate 12) in a similar manner as that of FIG. 6E, to drive an antenna 10/photodiode 14 pair of a different corresponding unit cell 100*a*. The optical fibers extend from one of the sides of the phased antenna array (e.g., across a side of rectangular ground plane 18). In this example, all of the v-grooves 46 may have their axes aligned in the same direction to connect to a corresponding optical fiber 50.

The reflectors 40 allow the optical fibers 50 to run along and conform to the surface of and parallel to the ground plane 18 to transmit an optical signal to a corresponding unit cell 100*a*. Antennas 10 of a fully populated phased array 100 are typically spaced at less than half the wavelength at the highest RF frequency to be radiated. For example, at 30 GHz, the spacing between the antenna elements is less than 5 mm. Such tight spacing of the antenna elements leaves little room for the antenna feeding network to provide driving signals (here, in the form of optical signals) to the antennas 10. In conventional optically fed antenna arrays, while the driving signal is delivered optically in a hair-thin optical fiber, the optical beam output at the end of an optical fiber to the corresponding antenna 10 is along a straight line corresponding to the axis of the optical fiber from which it was emitted, with optical fibers then connecting perpendicularly to the plane of the antenna array 100. This in turns leads increased depth of the antenna array 100 as combined with the antenna feeding network. The embodiments disclosed herein overcomes this shortcoming by redirecting the optical beam with reflectors 40 and thereby allowing the fibers 50 to be arranged in the plane of the phased array 100, and therefore contribute little to the depth of the antenna/feed network assembly.

The small size of the reflectors 40 allows tight packing of the in-plane optical-fiber feed network. The size of the reflectors 40 may have a maximum dimension (e.g., each of width, height, and length—or at least one or two of width, height and length) less than 2 mm or even less than 1 mm. The size of the reflectors 40 may be larger than the diameter of the optical fiber 50 (e.g., larger than 250 microns or larger than 125 microns) to accommodate the optical fiber 50. Thus, when the reflector 40 is positioned on the outside of the ground plane 18, it may only increase the thickness of the array no more than 2 mm or no more than 1 mm. In the example where the operational frequency of the phased array 100 is 4-15 GHz, h between the ground plane and the may be set to 6.5 mm+/−10% for example (which substantially corresponds to the thickness of the phased array 100 without the addition of the reflector 40). Thus, the total thickness of the phased array 100 may be less than about 9.2 mm, or about 7.5 mm+/−10% (with a reflector 1 mm in height) or about 8.5 mm+/−10% (with a reflector 2 mm in height).

The in-plane optical-fiber feed of fibers 50 also allow for other configurations that offer ease of installation, protection against failure during operation and/or from installation, and/or further reduction in width footprint. Specifically, while the reflector 40 has been shown to be attached to an outer surface of the ground plane 18, reflector 40 and the optical fibers 50 feeding the antenna 10/photodiode 14 pairs via reflector 40 may be positioned between the ground plane 18 and substrate 12, such as by mounting the reflector on the inner surface of ground plane 18 and running the optical fibers in a similar manner as described above, but between the ground plane 18 and substrate 12. Alternatively, the reflector 40 may be made integral with the photodiode 14, such as by mounting the reflector 40 to the upper surface or lower surface of the photodiode 14, or to a spacer that is in turn mounted on the substrate. In this instance, the optical fibers 50 may be formed to run across the inner surface of substrate 12 (e.g., on the uppermost surface of substrate 12, or within a groove of substrate 12) or fully embedded within substrate 12. As a further alternative to this latter example, each of the optical fibers 50 may be replaced by an optical waveguide formed as part of the substrate 12. In addition, in some examples, the reflector 40 may be formed integrally with photodiode 14 by forming the reflector within a substrate of the photodiode 14. The substrate forming the reflector 40 may be a crystalline wafer substrate used on which the photodiode 14 is epitaxially grown (the growth substrate, which may correspond to substrate 14*c* of FIG. 3) or a latter added support substrate (e.g., a crystalline diamond substrate used to dissipate heat generated from the photodiode, such as attached to the top of the photodiode 14 in FIG. 3C, or e.g., a crystalline diamond substrate replacing a growth substrate of the photodiode 14 corresponding to substrate 14*c* of FIG. 3C in this example).

The foregoing is illustrative of exemplary embodiments and is not to be construed as limiting thereof. Although a few exemplary embodiments have been described, those skilled in the art will readily appreciate that many modifications are possible without materially departing from the novel teachings and advantages of the inventive concepts. Accordingly, all such modifications are intended to be included within the scope of the present invention as defined in the claims.

What is claimed is:

1. A phased antenna array comprising:

an antenna array substrate and a conductive ground plane spaced apart from the antenna array substrate at a substantially constant distance and having a shape conforming to the shape of the antenna array substrate, the antenna array substrate having a first surface and a second surface opposite to its first surface, the conductive ground plane having a first surface and a second surface opposite to its first surface, where the first surface of the antenna array substrate and the first surface of the ground plane face each other;

a plurality of antennas arranged on the antenna array substrate;

a plurality of photodiodes each being electrically connected to a corresponding antenna to control the corresponding antenna;

a plurality of reflectors, each positioned to be in optical communication with a corresponding one of the photodiodes; and a plurality of optical waveguides, each optical waveguide positioned at its terminal end to conform to at least one of the first surfaces and the second surfaces of the antenna array substrate and the ground plane, each of the optical waveguides being in optical communication with a corresponding reflector to provide a corresponding optical signal to a corresponding one of the photodiodes via the corresponding reflector.

2. The phased antenna array of claim 1, wherein the optical waveguides comprise optical fibers, and wherein each of the optical fibers has an optical axis at its terminal end that is substantially parallel to at least one of the first surfaces and the second surfaces of the antenna array substrate and the ground plane.

3. The phased antenna array of claim 2, wherein each of the reflectors is attached to the ground plane and arranged adjacent to a corresponding one of the photodiodes, and wherein each of the reflectors is configured to reflect the optical signal provided by a corresponding optical fiber towards the antenna array substrate to impinge a corresponding one of the photodiodes.

4. The phased antenna array of claim 1, wherein the optical waveguides comprise optical fibers, and wherein the optical fibers extend from sides of the antenna array substrate and the ground plane.

5. The phased antenna array of claim 1, wherein the optical waveguides comprise optical fibers, and wherein all of the optical fibers extend across a first side of the ground plane.

6. The phased antenna array of claim 5, wherein the optical fibers are arranged in a plane between the ground plane and the antenna array substrate.

7. The phased antenna array of claim 1, wherein the phased antenna array is configured as a plurality of regularly arranged unit cells with each unit cell including an antenna/photodiode pair formed of one of the plurality of antennas and one of the plurality of photodiodes, and wherein each reflector is positioned adjacent to a corresponding antenna/photodiode pair of a unit cell.

8. The phased antenna array of claim 1, wherein the phased antenna array is configured as a plurality of regularly arranged unit cells with each unit cell including an antenna/photodiode pair formed of one of the plurality of antennas and one of the plurality of photodiodes, and wherein each of the optical waveguides extend in a corresponding direction that conforms to at least one of the first surfaces and second surfaces of the ground plane and antenna array substrate and terminates at a corresponding unit cell.

9. The phased antenna array of claim 1, wherein the optical waveguides comprise optical fibers, and wherein each optical fiber is positioned within a corresponding v-groove formed in a crystalline material.

10. The phased antenna array of claim 9, wherein each v-groove includes two sidewalls each composed of a crystalline facet of the crystalline material.

11. The phased antenna array of claim 10, wherein each v-groove includes two sidewalls each composed of a (111) surface of the crystalline material.

12. The phased antenna array of claim 9, wherein each of the v-grooves extend in the same direction.

13. The phased antenna array of claim 9, wherein each of the plurality of reflectors comprise a reflecting surface comprising a crystal facet of the crystalline material.

14. The phased antenna array of claim 13, wherein each reflector further comprises a transparent material filling the corresponding v-groove.

15. The phased antenna array of claim 14, wherein an index of refraction of the transparent material is substantially the same as an index of refraction of a material forming the optical fibers.

16. The phased antenna array of claim 13, wherein the reflecting surface comprises a reflective metal film.

17. The phased antenna array of claim 13, wherein the plurality of reflectors are each configured to reflect the corresponding optical signal via total internal reflection.

18. The phased antenna array of claim 1, wherein each reflector is formed of a crystalline material in which a reflecting surface and a first v-groove are formed, wherein each of the optical waveguides comprises an optical fiber, and wherein each reflector has a corresponding one of the optical fibers positioned within the corresponding first v-groove.

19. The phased antenna array of claim 18, wherein each reflector further comprises a second v-groove having an axis perpendicular to an axis of the first v-groove.

20. The phased antenna array of claim 18, wherein axes of the first v-grooves extend substantially in the same direction.

21. The phased antenna array of claim 1, wherein the plurality of reflectors are discrete from one another and are regularly arranged on the ground plane.

22. The phased antenna array of claim 1, wherein the phased antenna array is a tightly coupled antenna array with radiating arms of adjacent antennas being capacitively coupled to each other.

23. The phased antenna array of claim 22, wherein the radiating arms of adjacent antennas are capacitively coupled to each other with a corresponding discrete capacitor.

24. The phased antenna array of claim 1, wherein a total thickness of the phased antenna array is less than 9.2 mm.

25. The phased antenna array of claim 24, wherein each of the plurality of antennas comprise first and second radiating arms respectively connected to a cathode and an anode of a corresponding one of the photodiodes to which the antenna is connected, the first and second radiating arms each having a length less than 8.2 mm.

26. The phased antenna array of claim 24, wherein an operating frequency of the phased antenna array falls within the range of 4 GHz to 15 GHz.

27. The phased antenna array of claim 1, wherein the reflectors are each configured to reflect an incident light beam received from a corresponding optical waveguide at an angle substantially equal to ninety degrees.

28. The phased antenna array of claim 1, wherein the ground plane has a curved surface.

29. The phased antenna array of claim 1, wherein the plurality of antennas and the plurality of photodiodes form a plurality of antenna/photodiode pairs formed of one of the plurality of photodiodes and one of the plurality of antennas electrically connected together, wherein the antennas are dipole antennas that each comprise two radiating arms, and wherein, for each antenna/photodiode pair, a vertical distance from electrodes of the photodiode to the radiating arms of the dipole antenna is less than a length of the dipole antenna.

30. The phased antenna array of claim 29, wherein, for each antenna/photodiode pair, the vertical distance from electrodes of the photodiode to the radiating arms of the dipole antenna substantially corresponds to the thickness of the antenna array substrate.

31. The phased antenna array of claim 1, wherein each of the plurality of antennas is directly electrically connected to a corresponding one of the photodiodes with a corresponding conductor.

32. The phased antenna array of claim 1, wherein each of the plurality of antennas is directly electrically connected to a corresponding one of the photodiodes with a corresponding conductor having a length less than the length of a radiating arm of the antenna to which it is connected.

33. The phased antenna array of claim 1, wherein the plurality of antennas and the plurality of photodiodes form a plurality of antenna/photodiode pairs formed of one of a plurality of photodiodes and one of the plurality of antennas electrically connected together, and wherein each optical waveguide is operably connected to a corresponding one of the plurality of antennas to provide an optical signal to drive a corresponding photodiode/antenna pair.

34. The phased antenna array of claim 1, wherein each of the plurality of antennas is electrically connected to receive an RF electrical signal from a corresponding one of the plurality of photodiodes without use of an RF transmission line.

35. The phased antenna array of claim 1, wherein the antenna array substrate is an electrically insulative substrate of a printed circuit board, and wherein the plurality of antennas comprise radiating arms formed of a patterned metal layer of the printed circuit board.

36. The phased antenna array of claim 35, wherein the optical waveguides are embedded in the antenna array substrate.

37. The phased antenna array of claim 1, wherein the optical waveguides are elements formed within the antenna array substrate.

38. The phased antenna array of claim 1, wherein each of the reflectors is integrally formed with a corresponding one of the photodiodes.

39. The phased antenna array of claim 38, wherein each of photodiodes comprises a crystalline growth substrate and each of the reflectors is formed in the growth substrate of the corresponding one of the photodiodes with which it is integrally formed.

40. The phased antenna array of claim 1, wherein the plurality of antennas comprise radiating arms formed of a patterned metal layer of semiconductor chips that are mounted to the antenna array substrate.

* * * * *